US005871070A

United States Patent [19]

Contreras

[11] Patent Number: 5,871,070

[45] Date of Patent: Feb. 16, 1999

[54] OVERHEAD STORAGE LIFT ASSEMBLY

[76] Inventor: Hugo Contreras, 1201 Maddox St., Long Beach, Calif. 90810

[21] Appl. No.: 804,387

[22] Filed: Feb. 21, 1997

[51] Int. Cl.[6] ..... B66B 11/08

[52] U.S. Cl. ..... 187/263

[58] Field of Search ..... 187/263; 312/247

[56] References Cited

U.S. PATENT DOCUMENTS 1,338,127 4/1920 Felt ..... 187/263

2,643,662 6/1953 Bunce ..... 187/263

*Primary Examiner*—William E. Terrell

*Assistant Examiner*—Khoi H. Tran

[57] ABSTRACT

An overhead storage lift assembly comprises first and second brace members each having a vertical and a horizontal segment. Pulley wheel is coupled at the end of each horizontal segment. A platform is being raised and lowered by four cables attached to its four corners. The first and second cables are threaded within the horizontal segment of the first brace member. The third and fourth cables are threaded through an aperture in the first brace member and positioned within the horizontal segment of the second brace member. A crank case with a worm drive shaft meshing with a drive gear is used for winding the cables in order to raised or lowered the platform.

8 Claims, 3 Drawing Sheets

OVERHEAD STORAGE LIFT ASSEMBLY

BACKGROUND OF THE INVENTION

1. Field of the Invention

The present invention relates to an overhead storage lift assembly and more particularly pertains to storing articles above ground.

2. Description of the Prior Art

The use of storage systems is known in the prior art. More specifically, storage systems heretofore devised and utilized for the purpose of storing various items are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,199,843 to Sferra discloses an overhead storage system.

U.S. Pat. No. 4,412,601 to Cooper discloses an elevator storage system.

U.S. Pat. No. 4,076,351 to Wyant discloses an up-down cabinet.

U.S. Pat. No. 5,148,889 to Fenwick discloses a high level package retrieval system.

U.S. Pat. No. 4,898,286 to Orlandi discloses a storage system and connector for the same.

U.S. Pat. No. 4,915,461 to Kingsborough discloses a storage cabinet retrieval system.

While these devices fulfill their respective, particular objective and requirements, the aforementioned patents do not describe an overhead storage lift assembly for storing articles above ground.

In this respect, the overhead storage lift assembly according to the present invention substantially departs from the conventional concepts and designs of the prior art, and in doing so provides an apparatus primarily developed for the purpose of storing articles above ground.

Therefore, it can be appreciated that there exists a continuing need for new and improved overhead storage lift assembly which can be used for storing articles above ground. In this regard, the present invention substantially fulfills this need.

SUMMARY OF THE INVENTION

In the view of the foregoing disadvantages inherent in the known types of storage systems now present in the prior art, the present invention provides an improved overhead storage lift assembly. As such, the general purpose of the present invention, which will be described subsequently in greater detail, is to provide a new and improved overhead storage lift assembly and method which has all the advantages of the prior art and none of the disadvantages.

To attain this, the present invention essentially comprises a new and improved overhead storage lift assembly comprising, in combination: first and second L-shaped brace members, each brace member including a vertical segment formed in a planar, generally rectangular configuration with a plurality of apertures extending therethrough, each brace member further including a horizontal segment formed in an elongated generally rectangular configuration with two side faces, an upper face and a lower face, each horizontal segment having an outboard end including an outboard pulley wheel rotatably coupled thereto, the horizontal segment of the first brace member having an inboard end with an aperture extending through both side faces, the horizontal segment of the second brace member having an aperture extending through one side face, each horizontal segment including an inboard pulley wheel coupled therein, cross bars being affixed to the vertical and horizontal segments, in an operative orientation the vertical segments being coupled to a vertical wall of a building structure; a platform being formed in a planar generally rectangular configuration, the platform having a raised and reinforced outer periphery with front and rear corners, each corner including coupling means; a crank case formed in a generally rectangular configuration with a hollow interior, an upper face and a front face, a drive gear being rotatably coupled within the crank case, a central axle extending from the drive gear and through the upper face of the crank case, a handle having an outboard end configured in an L-shaped orientation, the handle having an inboard end formed as a worm drive shaft, the worm drive shaft being in meshing communication with the drive gear, a sawtooth gear formed in a generally circular configuration and positioned within the crank case adjacent to the drive gear, the sawtooth gear including a plurality of generally triangular teeth extending radially therefrom, a release switch extending through the crank case and being positioned between the teeth of the sawtooth gear, the axle having an upper end including five disk shaped dividers; and first, second, third and fourth cables each being formed in an elongated cylindrical configuration, each cable being positioned around the axle between a divider, the first and second cable being positioned within the horizontal segment of the first brace member, the first cable extending downwardly adjacent to the inboard end of the first brace member and being coupled to a rear corner of the platform, the second cable extending downwardly from the outboard end of the first brace member over the outboard pulley and being coupled to a front corner of the platform, the third and fourth cables extending through the aperture in the first brace member and being positioned within the horizontal segment of the second brace member, the third cable extending downwardly adjacent to the inboard end of the second brace member and being coupled to a rear corner of the platform, the fourth cable extending downwardly from the outboard end of the second brace member over the outboard pulley and being coupled to a front corner of the platform, in an operative orientation a user rotating the outboard end of the handle thereby rotating the worm drive shaft, this action causing rotation of the axle and dividers thereby winding the cables and raising the platform, the sawtooth gear securing the platform at a desired height, a user depressing the release switch thereby releasing the sawtooth gear and unwinding the cables to lower the platform.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved overhead storage lift assembly which has all the advantages of the prior art storage systems and none of the disadvantages.

It is another object of the present invention to provide a new and improved overhead storage lift assembly which may be easily and efficiently manufactured and marketed.

It is a further object of the present invention to provide a new and improved overhead storage lift assembly which is of durable and reliable construction.

An even further object of the present invention is to provide a new and improved overhead storage lift assembly which is susceptible of a low cost of manufacture with regard to both materials and labor, and which accordingly is then susceptible of low prices of sale to the consuming public, thereby making such an overhead storage lift assembly economically available to the buying public.

Even still another object of the present invention is to provide a new and improved overhead storage lift assembly for storing articles above ground.

Lastly, it is an object of the present invention to provide a new and improved overhead storage lift assembly comprising: first and second brace members, each brace member including a horizontal segment with a pulley wheel rotatably coupled thereto and a vertical segment; a platform having front and rear corners and a raised outer periphery; a crank case including a drive gear and a sawtooth gear with a plurality of teeth, a central axle extending from the drive gear and through the crank case, a handle having an inboard end formed as a worm drive shaft, the worm drive shaft being in meshing communication with the drive gear, a release switch being positioned between the teeth of the sawtooth gear, the axle including a plurality of disc shaped dividers; and a plurality of cables being positioned around the axle between a divider, first and second cables being positioned within the horizontal segment of the first brace member, third and fourth cables extending through the aperture in the first brace member and being positioned within the horizontal segment of the second brace member, each cable being coupled to a corner of the platform, in an operative orientation a user rotating the handle, this action causing rotation of the axle and dividers thereby winding the cables and raising the platform, the sawtooth gear securing the platform at a desired height, a user depressing the release switch thereby releasing the sawtooth gear and unwinding the cables to lower the platform.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
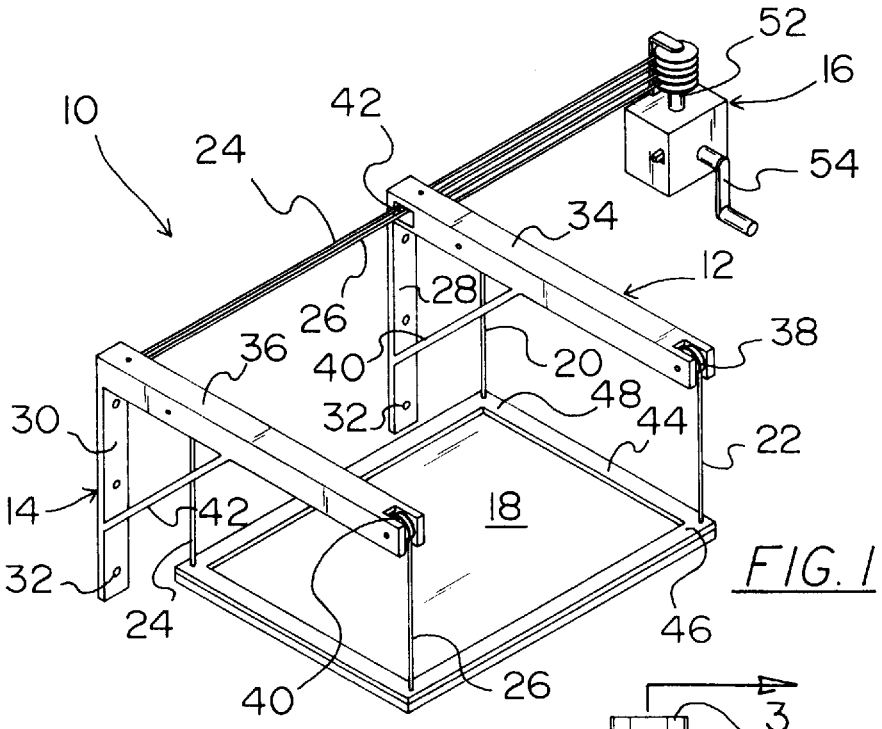
FIG. 1 is a perspective view of the preferred embodiment of the overhead storage lift assembly constructed in accordance with the principles of the present invention.

With reference now to the drawings, and in particular, to FIG. 1 thereof, the preferred embodiment of the new and improved overhead storage lift assembly embodying the principles and concepts of the present invention and generally designated by the reference number 10 will be described.

Specifically, it will be noted in the various Figures that the device relates to a new and improved overhead storage lift assembly 10. In its broadest context, the device consists of first and second brace members 12, 14, a crank case 16, a platform 18, a first cable 20, a second cable 22, a third cable 24 and a fourth cable 26. Such components are individually configured and correlated with respect to each other so as to attain the desired objective.

First and second L-shaped brace members 12, 14 are included with the apparatus. In the preferred embodiment the brace members are fabricated of metal and are 2 feet high and four feet long. Each brace member includes a vertical segment 28, 30 which is formed in a planar, generally rectangular configuration. Each vertical segment includes a plurality of apertures 32 extending through it. In the preferred embodiment three apertures and three stud mounted screws are included. The apertures provide a method for mounting the apparatus to a wall. Each brace member further includes a horizontal segment 34, 36 which is formed in an elongated generally rectangular configuration with two side faces, an upper face and a lower face. Note FIG. 1.

Each horizontal segment has an outboard end which includes an outboard pulley wheel 38, 38' rotatably coupled to it. The horizontal segment 34 of the first brace member has an inboard end with an aperture 42 extending through both side faces. The horizontal segment 36 of the second brace member has an aperture extending through one side face. Each horizontal segment 34, 36 includes an inboard pulley wheel coupled within its interior. Each pulley wheel is fabricated of UHMW material to eliminate the need for lubrication. Cross bars 40, 42 are affixed between the vertical and horizontal segments. In an operative orientation the vertical segments 28, 30 are coupled to a vertical wall of a building structure such as a garage. Note FIG. 1.

The platform 18 is formed in a planar generally rectangular configuration. In the preferred embodiment of the apparatus a lawn mover or other lawn equipment is stored on the platform. The platform has a raised and reinforced outer periphery 44 with front and rear corners 46, 48. The raised and reinforced periphery prevents objects on the platform from unintentionally sliding off. In the preferred embodiment the platform is four feet wide, six feet long and ¾ inch high. The outer periphery includes an aluminum channel that is 2 inches wide and ⅛ inch high. Each corner includes coupling means. Note FIG. 1.

Figure 2:
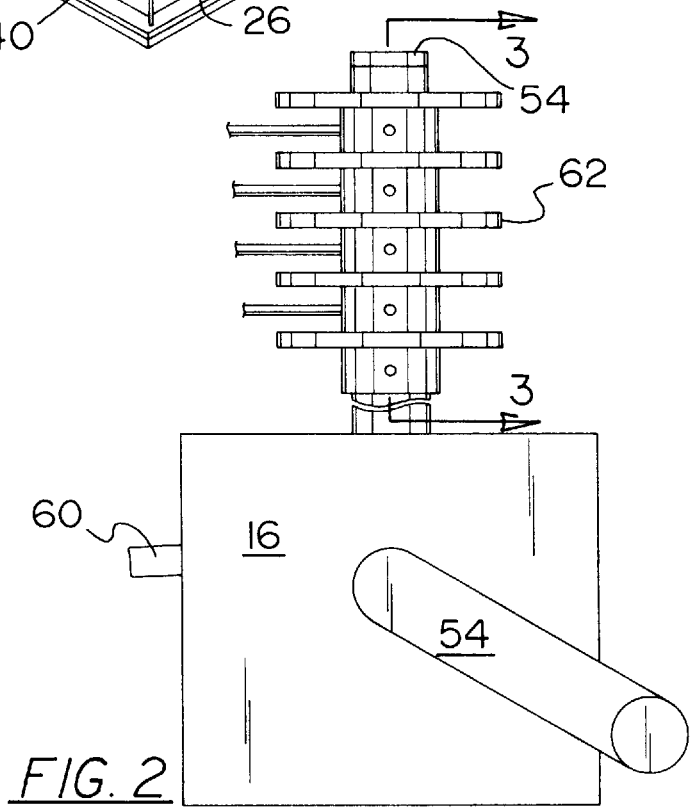
FIG. 2 discloses an isolated perspective view of the crank case of the apparatus.
Figure 3:
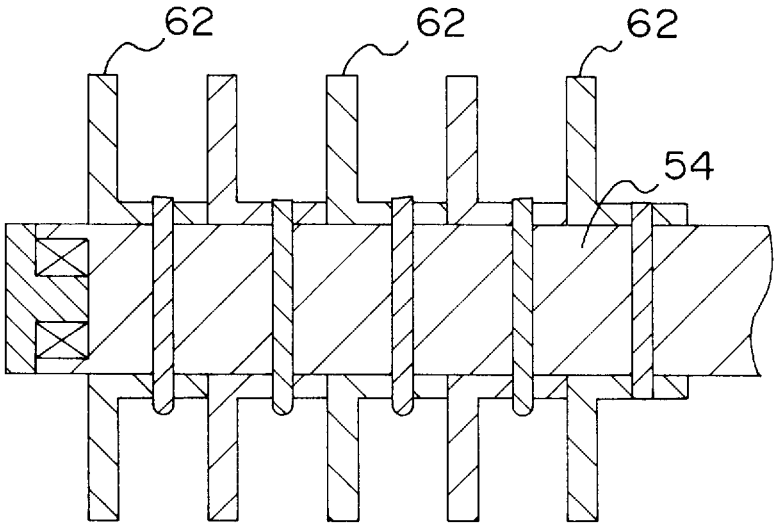
FIG. 3 discloses a cross sectional view of the cable dividers taken long section line 3—3 of FIG. 2.

The crank case 16 is formed in a generally rectangular configuration with a hollow interior, an upper face and a front face. A drive gear 50 is rotatably coupled within the crank case. A central axle 52 extends from the drive gear and through the upper face of the crank case. A handle 54 has an outboard end configured in an L-shaped orientation. The handle has an inboard end formed as a worm drive shaft 56. The worm drive shaft is in meshing communication with the drive gear 50. A sawtooth gear 58 is formed in a generally circular configuration and positioned within the crank case adjacent to the drive gear. The sawtooth gear includes a plurality of generally triangular teeth extending radially from it. A release switch 60 extends through the crank case and is positioned between the teeth of the sawtooth gear. The axle 52 has an upper end including five disk shaped dividers 62. Note FIGS. 2 and 5.

First 20, second 22, third 24 and fourth cables 26 each are formed in an elongated cylindrical configuration. Each cable is positioned around the axle 54 between a divider 62. The first and second cable 20, 22 are positioned within the horizontal segment of the first brace member 34. The first cable extends downwardly adjacent to the inboard end of the first brace member and is coupled to a rear corner of the platform 48. The second cable extends downwardly from the outboard end of the first brace member over the outboard pulley 38 and is coupled to a front corner of the platform 46. Note FIGS. 1, 2 and 5.

The third and fourth cables 24, 26 extend through the aperture 42 in the first brace member and are positioned within the horizontal segment 36 of the second brace member. The third cable 24 extends downwardly adjacent to the inboard end of the second brace member 36 and is coupled to a rear corner of the platform 48. The fourth cable 26 extends downwardly from the outboard end of the second brace member over the outboard pulley 38' and is coupled to a front corner 46 of the platform. Note FIGS. 1 and 2.

In an operative orientation a user rotates the outboard end of the handle thereby rotating the worm drive shaft 56. This action causes rotation of the axle 54 and dividers, thereby winding the cables and raising the platform. The sawtooth gear secures the platform at a desired height. In an operative orientation, a user depresses the release switch, thereby releasing the sawtooth gear and unwinding the cables to lower the platform. The present invention provides users a method for storing items such as a lawn mower in a garage in a raised orientation. This can save floor space in the garage while safely storing large items. Note FIGS. 1, 2, 3 and 5.

Figure 4:
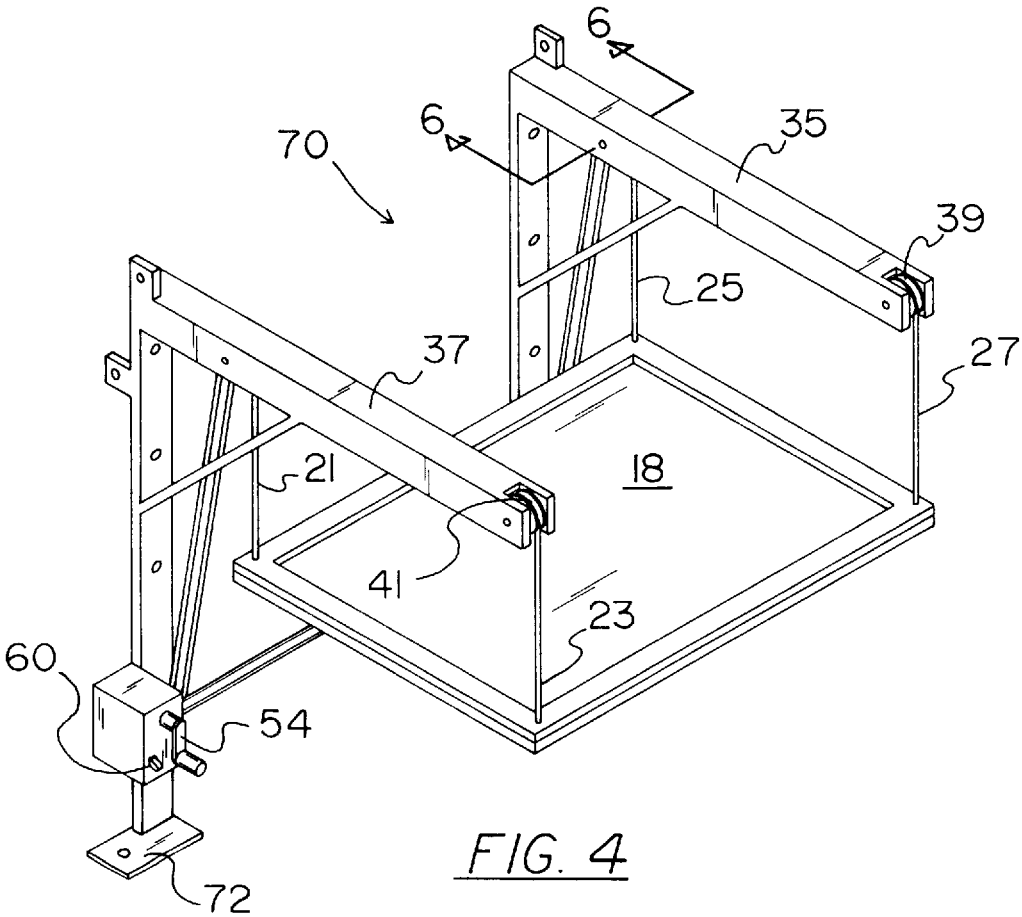
FIG. 4 discloses a perspective view of an alternate embodiment of the apparatus.
Figure 5:
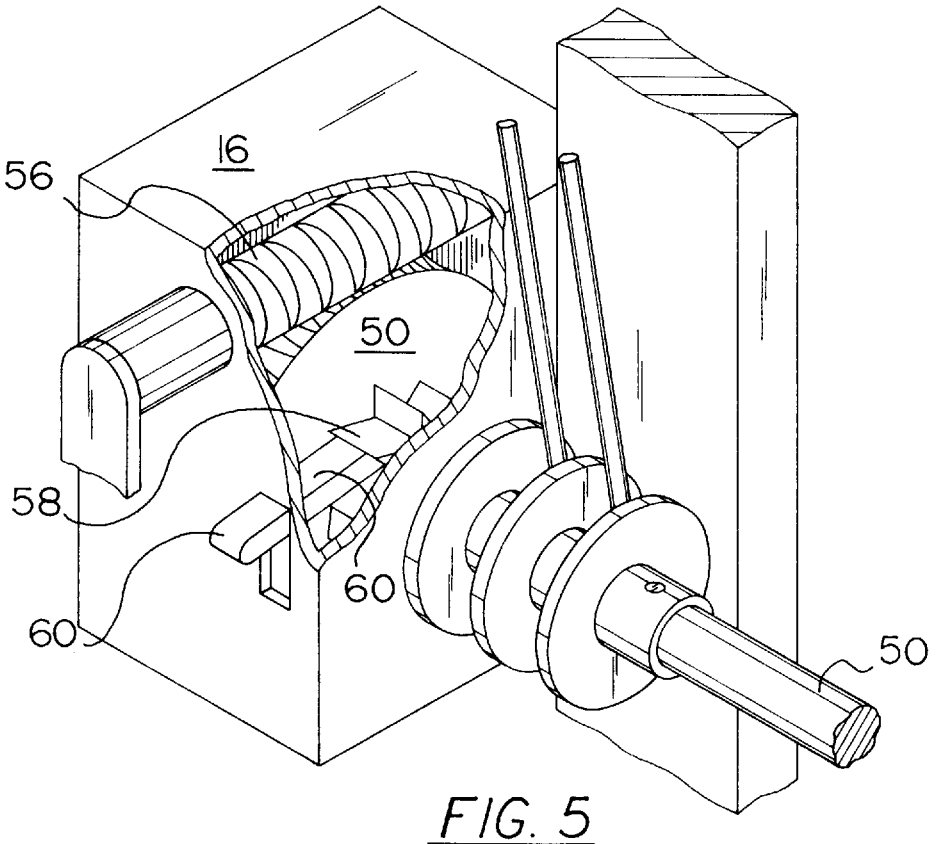
FIG. 5 discloses a partially broken away perspective view of the crank case of the alternate embodiment of the apparatus.
Figure 6:
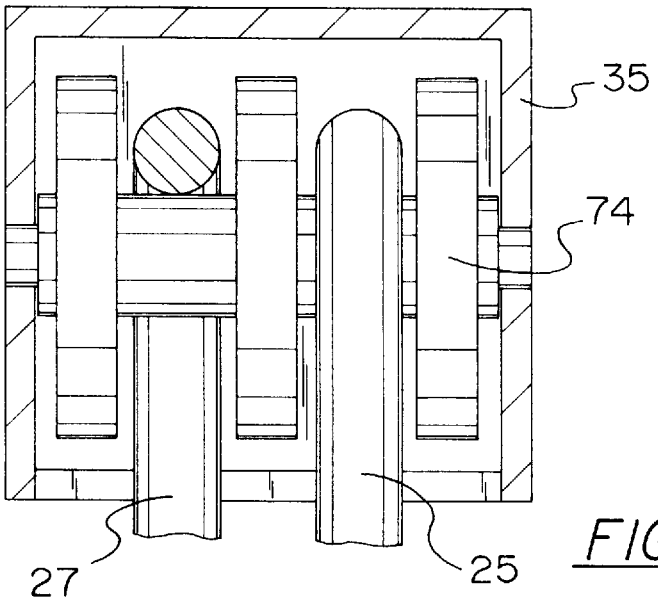
FIG. 6 discloses a cross sectional view taken along section line 6—6 of FIG. 4.

A second embodiment 70 of the present invention is shown in FIGS. 4–6 and includes substantially all of the components of the present invention. The second embodiment further includes floor mounting brackets 72 located at the lower end of the first and second brace members 35, 37. The floor mounting bracket includes an aperture and associated mounting bolt. The crank case 16 is mounted on the second brace member 37. The first and second cables 21, 23 extend upwardly to the horizontal segment of the second brace member 37. Note FIG. 4.

Each horizonal segments includes a pulley 74 within its interior. The first cable 21 extends downwardly adjacent to the inboard end of the first brace member and is coupled to a rear corner of the platform 18. The second cable 23 extends downwardly from the outboard end of the first brace member over the outboard pulley 41 and is coupled to a front corner of the platform. Note FIGS. 4–6.

The third and fourth cables 25, 27 extend laterally to the horizontal segment of the first brace member 35. The third and fourth cables are positioned within the first brace member over the pulley 74. The third cable 25 extends downwardly adjacent to the inboard end of the first brace member 35 and is coupled to a rear corner of the platform. The fourth cable 27 extends downwardly from the outboard end of the first brace member over the outboard pulley 39 and being coupled to a front corner of the platform. Note FIGS. 4 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved overhead storage lift assembly comprising, in combination:

first and second L-shaped brace members, each brace member including a vertical segment formed in a planar, generally rectangular configuration with a plurality of apertures extending therethrough, each brace member further including a horizontal segment formed in an elongated generally rectangular configuration with two side faces, an upper face and a lower face, each horizontal segment having an outboard end including an outboard pulley wheel rotatably coupled thereto, the horizontal segment of the first brace member having an inboard end with an aperture extending through both side faces, the horizontal segment of the second brace member having an aperture extending through one side face, each horizontal segment including an inboard pulley wheel coupled therein, cross bars being affixed to the vertical and horizontal segments, in an operative orientation the vertical segments being coupled to a vertical wall of a building structure;

a platform being formed in a planar generally rectangular configuration, the platform having a raised and reinforced outer periphery with front and rear corners, each corner including coupling means;

a crank case formed in a generally rectangular configuration with a hollow interior, an upper face and a front face, a drive gear being rotatably coupled within the crank case, a central axle extending from the drive gear and through the upper face of the crank case, a handle having an outboard end configured in an L-shaped orientation, the handle having an inboard end formed as a worm drive shaft, the worm drive shaft being in meshing communication with the drive gear, a sawtooth gear formed in a generally circular configuration and positioned within the crank case adjacent to the drive gear, the sawtooth gear including a plurality of generally triangular teeth extending radially therefrom, a release switch extending through the crank case and being positioned between the teeth of the sawtooth gear, the axle having an upper end including five disk shaped dividers; and first, second, third and fourth cables each being formed in an elongated cylindrical configuration, each cable being positioned around the axle between a divider, the first and second cable being positioned within the horizontal segment of the first brace member, the first cable extending downwardly adjacent to the inboard end of the first brace member and being coupled to a rear corner of the platform, the second cable extending downwardly from the outboard end of the first brace member over the outboard pulley and being coupled to a front corner of the platform, the third and fourth cables extending through the aperture in the first brace member and being positioned within the horizontal segment of the second brace member, the third cable extending downwardly adjacent to the inboard end of the second brace member and being coupled to a rear corner of the platform, the fourth cable extending downwardly from the outboard end of the second brace member over the outboard pulley and being coupled to a front corner of the platform, in an operative orientation a user rotating the outboard end of the handle thereby rotating the worm drive shaft, this action causing rotation of the axle and dividers thereby winding the cables and raising the platform, the sawtooth gear securing the platform at a desired height, a user depressing the release switch thereby releasing the sawtooth gear and unwinding the cables to lower the platform.

2. An overhead storage lift assembly comprising, in combination:

first and second brace members, each brace member including a horizontal segment with a pulley wheel rotatably coupled thereto and a vertical segment;

a platform having front and rear corners and a raised outer periphery;

a crank case including a drive gear and a sawtooth gear with a plurality of teeth, a central axle extending from the drive gear and through the crank case, a handle having an inboard end formed as a worm drive shaft, the worm drive shaft being in meshing communication with the drive gear, a release switch being positioned between the teeth of the sawtooth gear, the axle including a plurality of disc shaped dividers; and a plurality of cables being positioned around the axle between a divider, first and second cables being positioned within the horizontal segment of the first brace member, third and fourth cables extending through the aperture in the first brace member and being positioned within the horizontal segment of the second brace member, each cable being coupled to a corner of the platform, in an operative orientation a user rotating the handle, this action causing rotation of the axle and dividers thereby winding the cables and raising the platform, the sawtooth gear securing the platform at a desired height, a user depressing the release switch thereby releasing the sawtooth gear and unwinding the cables to lower the platform.

3. The overhead storage lift assembly as set forth in claim 2 wherein each bracket member is formed in a generally L-shaped configuration and each segment is formed in a rectangular configuration.

4. The overhead storage lift assembly as set forth in claim 2 wherein the first cable extends downwardly adjacent to the inboard end of the first brace member and is coupled to a rear corner of the platform, the second cable extending downwardly from the outboard end of the first brace member over the outboard pulley and being coupled to a front corner of the platform, the third cable extending downwardly adjacent to the inboard end of the second brace member and being coupled to a rear corner of the platform, the fourth cable extending downwardly from the outboard end of the second brace member over the outboard pulley and being coupled to a front corner of the platform.

5. The overhead storage lift assembly as set forth in claim 2 wherein the first and second brace members including floor mounting brackets, the crank case being mounted on the second brace member, the first and second cables extending upwardly to the horizontal segment of the second brace member, the first cable extending downwardly adjacent to the inboard end of the first brace member and being coupled to a rear corner of the platform, the second cable extending downwardly from the outboard end of the first brace member over the outboard pulley and being coupled to a front corner of the platform, the third and fourth cables extending laterally to the horizontal segment of the first brace member, the third cable extending downwardly adjacent to the inboard end of the first brace member and being coupled to a rear corner of the platform, the fourth cable extending downwardly from the outboard end of the first brace member over the outboard pulley and being coupled to a front corner of the platform.

6. The overhead storage lift assembly as set forth in claim 2 and further including:

cross bars being affixed to the vertical and horizontal segments.

7. The overhead storage lift assembly as set forth in claim 2 wherein five disc shaped dividers are included with the apparatus.

8. The overhead storage lift assembly as set forth in claim 5 wherein three disc shaped dividers are included with the apparatus.

* * * * *